United States Patent [19]

Liao

[11] Patent Number: 5,051,877

[45] Date of Patent: Sep. 24, 1991

[54] MINIATURE LIGHT SET

[76] Inventor: Nan W. Liao, No. 18, Tzu Yu Road, Hsinchu, Taiwan

[21] Appl. No.: 609,154

[22] Filed: Nov. 5, 1990

[51] Int. Cl.[5] ..... F21V 21/00

[52] U.S. Cl. ..... 362/249; 362/252; 362/806; 439/419

[58] Field of Search ..... 439/419, 425; 362/249, 362/252, 238, 806, 811

[56] References Cited

U.S. PATENT DOCUMENTS

| | | | |
|---|---|---|---|
| 2,587,239 | 2/1952 | Smith | 439/425 |
| 4,516,822 | 5/1985 | Wolfel | 439/425 |
| 4,777,573 | 10/1988 | Liao | 439/419 |
| 4,830,626 | 5/1989 | Liu | 439/425 |
| 4,842,546 | 6/1989 | Song | 439/425 |
| 4,964,816 | 10/1990 | Miller | 439/425 |

*Primary Examiner*—Ira S. Lazarus
*Assistant Examiner*—Y. Quach
*Attorney, Agent, or Firm*—Morton J. Rosenberg; David I. Klein

[57] ABSTRACT

An improved miniature light set applied to a series-parallel decorative light string including a seat with hooks to engage with respective holes of a base, a pair of conductors with wire piercing peaks to be inserted into a slotted openings formed in the base, and a set of wires placed between the seat and the base. Two opposing sides of both the seat and the base, respectively, are provided with flat portions, symmetrically arranged, to be engaged by automatic devices.

3 Claims, 16 Drawing Sheets

MINIATURE LIGHT SET

BACKGROUND OF THE INVENTION

The present invention relates to an improved miniature light set which is combined with a seat to be firmly mounted on a cord, and more particularly relates to a light set having the seat being capable of connecting with a base of the light set by automatic machines.

In prior art systems, various types of miniature light sets have been developed for application to a series-parallel decorative light string. As in U.S. Pat. Nos. 4,631,650 and 4,777,573, lampholders are provided with a snap-on cover at their base end which swings into a closed position and provides a wireway with the rest of the lampholder housing. The two Patents are capable of providing a light set which is firmly combined. But, both of which must be manually assembled to combine the seat with the lampholder. Such increases the cost and is not effective.

SUMMARY OF THE INVENTION

The prior art articles are lacking in novelty and utility. It is the purpose of this present invention, therefore, to mitigate and/or obviate the abovementioned drawbacks in the manner set forth in the detailed description of the preferred embodiment.

A primary objective of this invention is to provide a light set which can be automatically produced by machines for connecting the seat with the base of a lampholder.

Another objective of the present invention is to provide an improved light set which has a seat and a base, both of which are provided with two side flat surface portions to be symmetrically positioned on opposing sides thereof for being transported by automatic equipment.

Further objectives and advantages of the present invention will become apparent from the following detailed description when considered in connection with the accompanying drawings wherein:

DETAILED DESCRIPTION OF THE PREFERRED EMBODIMENT

Figure 1:
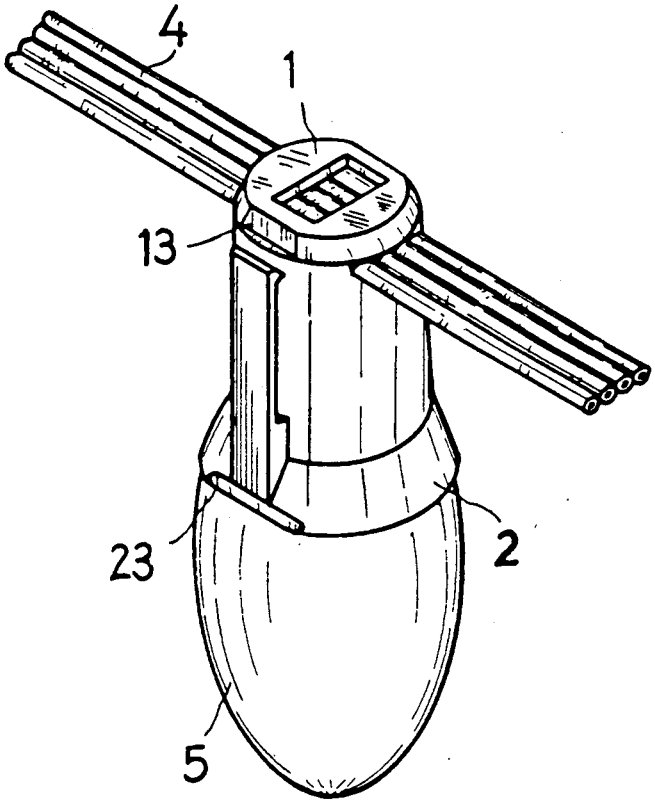
FIG. 1 is an exploded perspective view of a preferred embodiment in accordance with the present invention.
Figure 2:
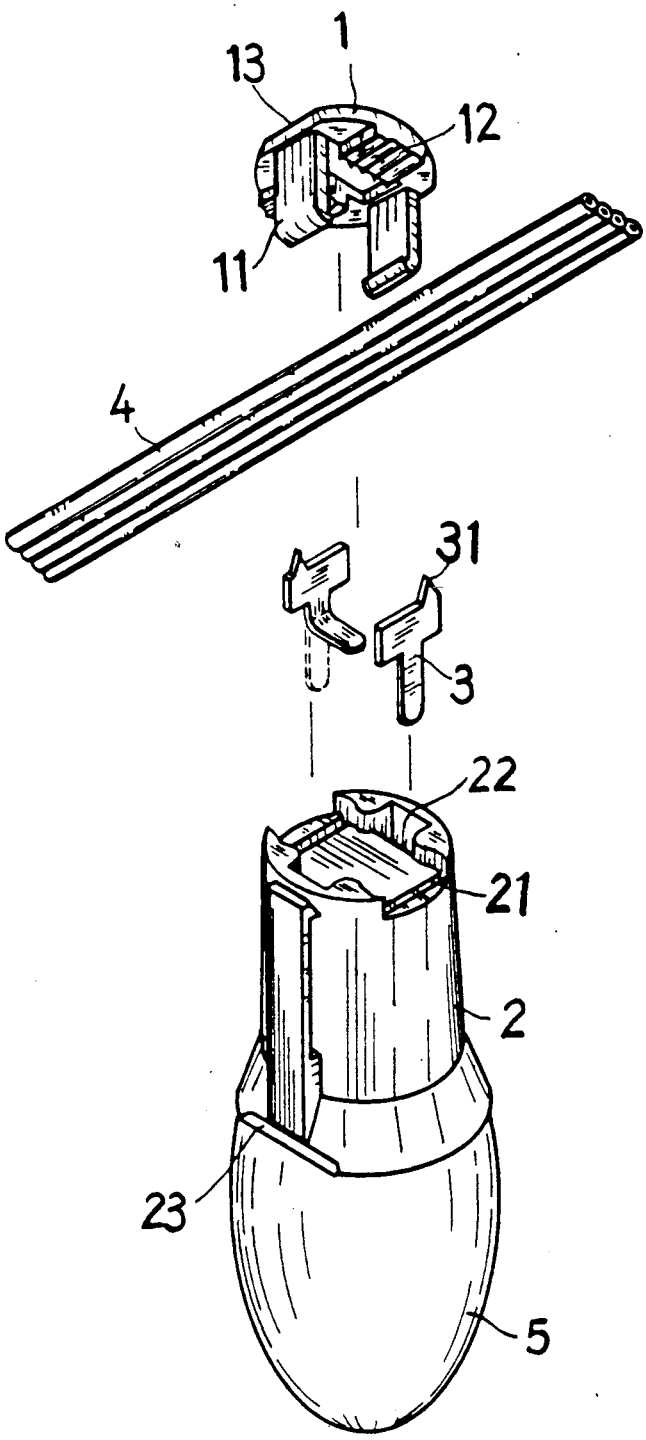
FIG. 2 is a perspective view of a preferred embodiment in accordance with the present invention.
Figure 3:
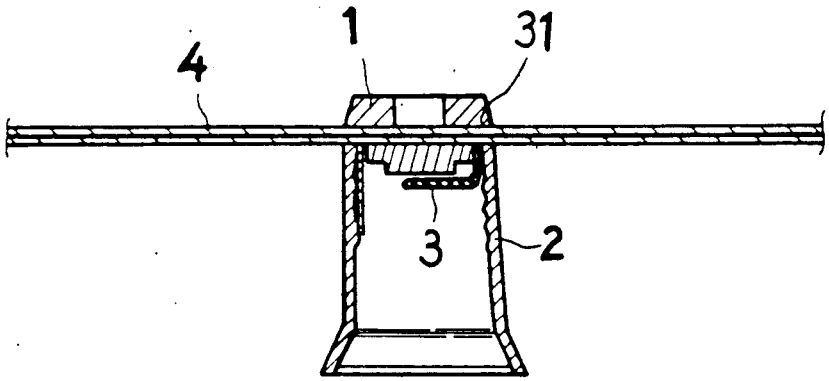
FIG. 3 is a cross-sectional view of a preferred embodiment in accordance with the present invention.

Referring to FIGS. 1–3, it can be seen that the present invention includes a seat 1 and a base 2, wherein the bottom of the base 2 is provided with two slotted openings 21 and two holes 22 disposed within a recess. The holes 22 being disposed in a direction perpendicular to the slotted openings 21. A set of wires 4 is placed at the bottom of the base 2 with two outward extended ends. A bulb 5 is connected to the base 2. The seat 1 includes two hooks 11, each for engagement with a respective one of the two holes 22 of the base for firmly coupling one with each other. A pair of conductors 3 are each inserted into a respective one of the two grooves 21 of the base 2. Each of the conductors 3 has wire piercing peaks 31 directed toward the seat 1. Several curved grooves 12 are formed at bottom side of the seat 1 to firmly press the wires 4 therebetween during the assembly of the seat to the base 2, wherein the peaks 31 of the conductors 3 pierce the insulation of the wires to make contact with the conductors. As shown in FIGS. 11–16, as many as five conductors may be captured between base 2 and seat 1.

The main characteristic of the present invention is shown in the Figures. Two opposing sides of the seat 1 are formed with respective flat portion 13 symmetrically arranged thereon. Two similar flat portions 23 are symmetrically formed on opposing sides of the base 2, adjacent the bulb receiving end. By use of suitable automatic machines, the base 2 and the seat 1 can be tranported in the same direction by vibration in two respective transporting lines, by virtue of the respective flat portions 23 and 13. Another machine is then used to press the seat 1 down to engage the base 2. So it can be easily understood how the improved structure of this invention provides a utilitarian and useful design adapted for manufacture by automated mass production techniques.

Figure 4:
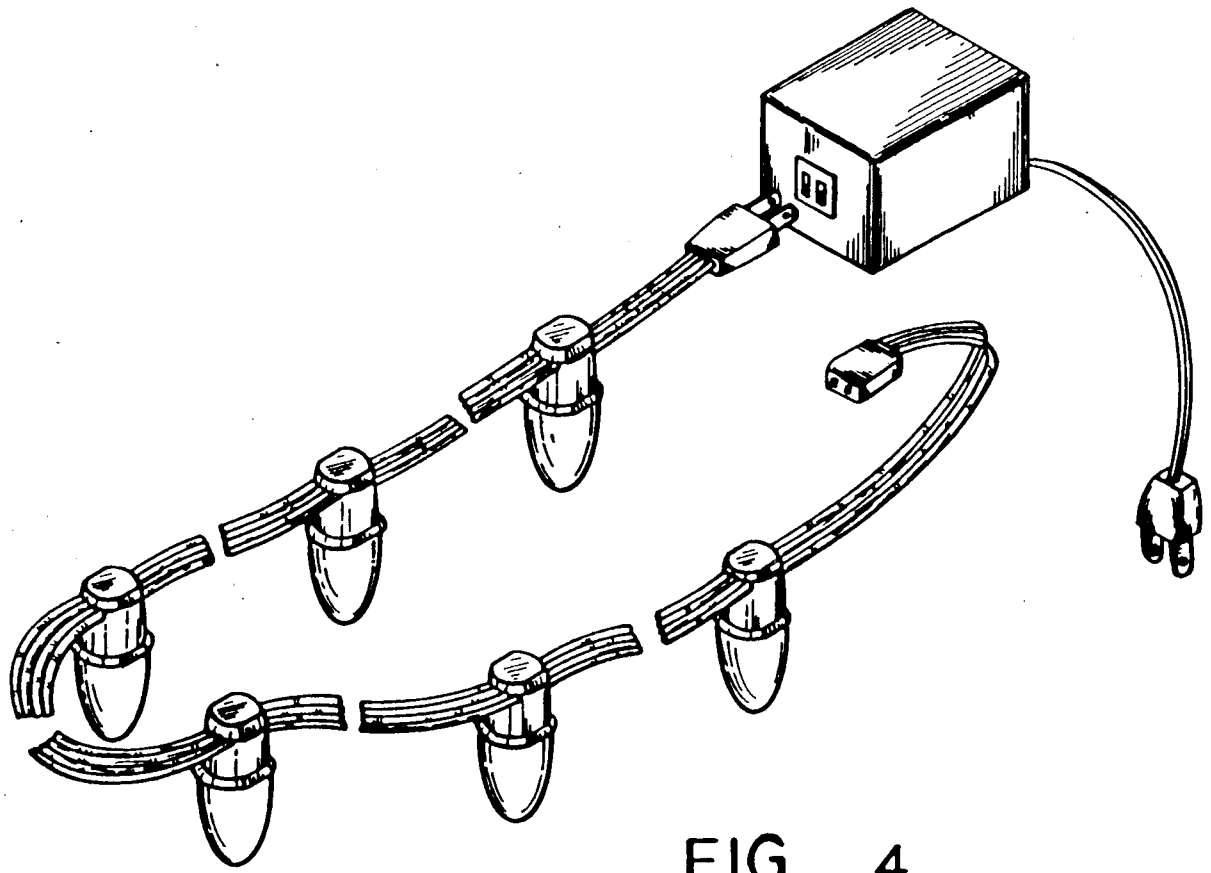
FIGS. 4–6 are several examples of embodiments of different types in accordance with the present invention; and, FIGS. 7–16 are several examples of different states of different light sets in accordance with the present invention.
Figure 5:
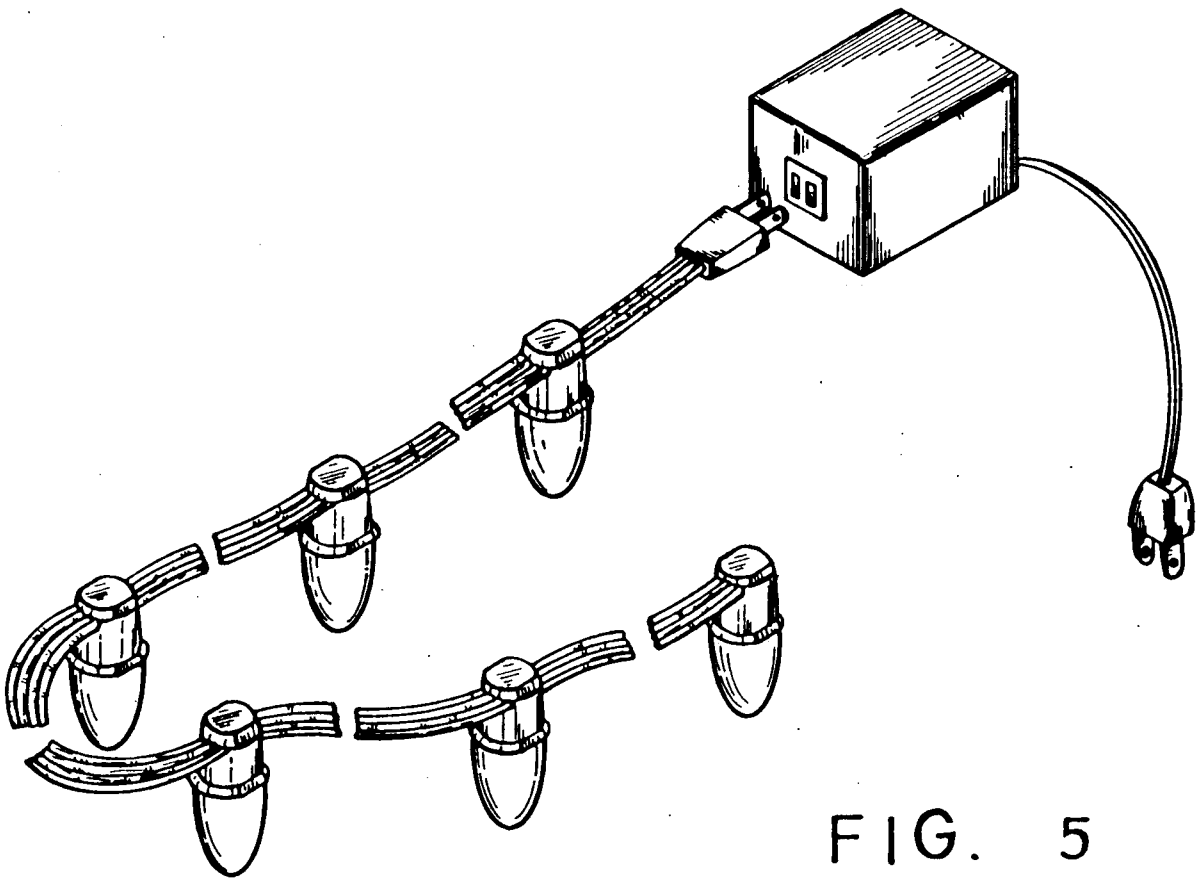
Figure 6:
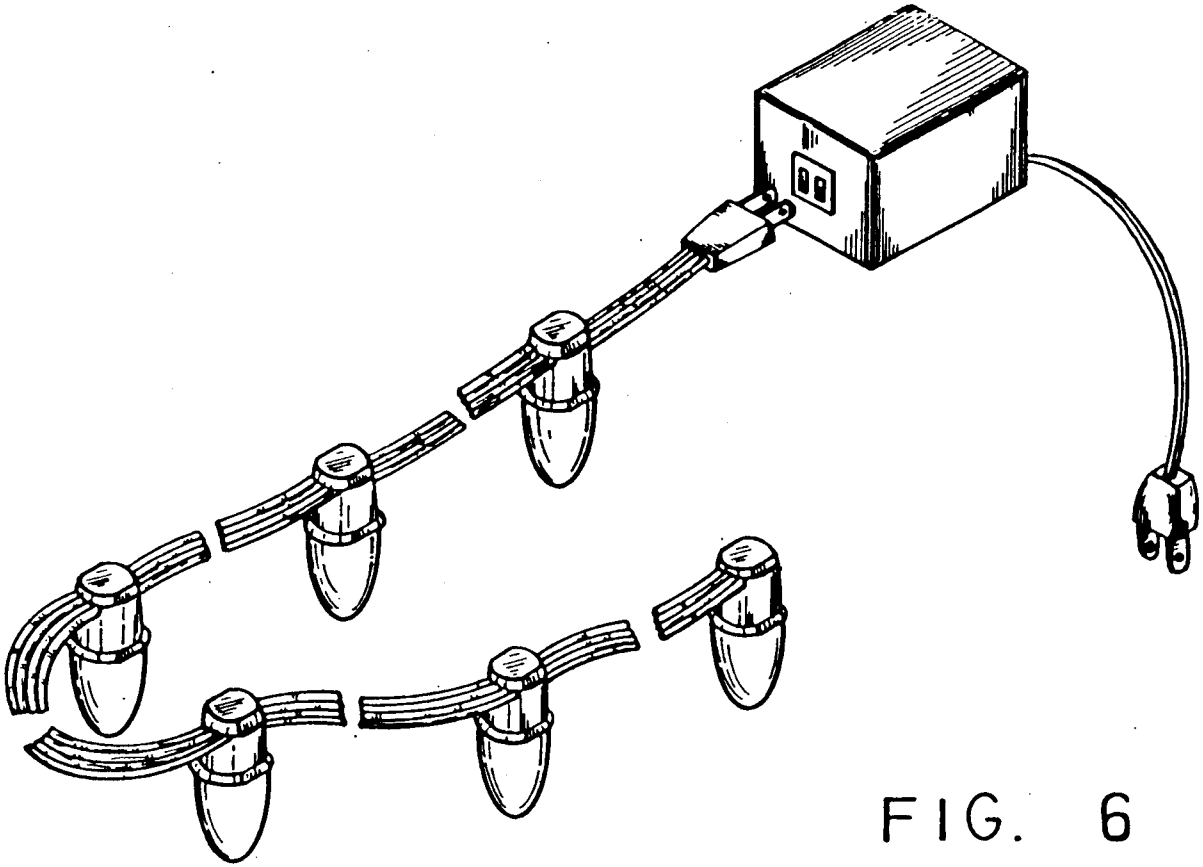
Figure 7:
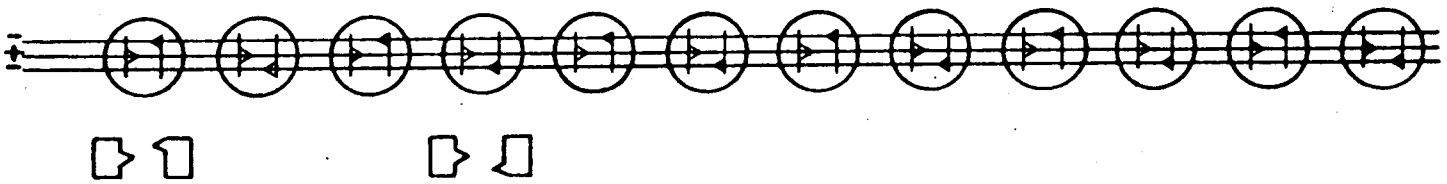
Figure 8:
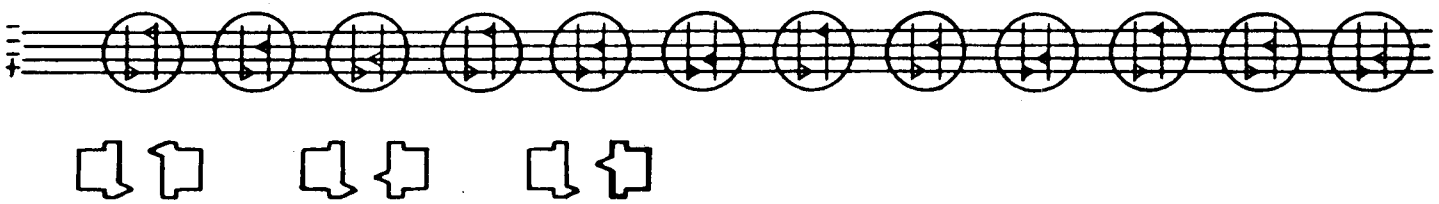
Figure 9:
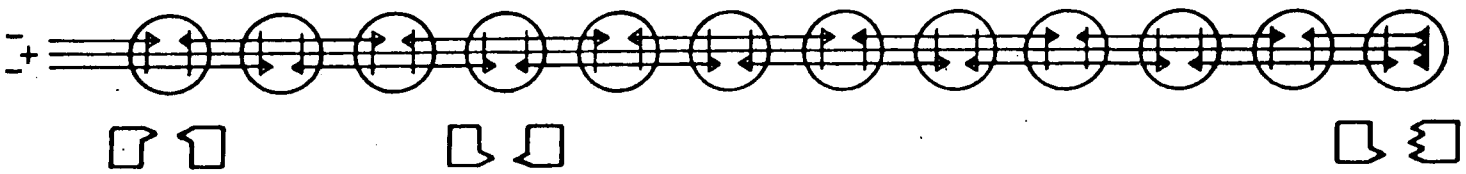
Figure 10:
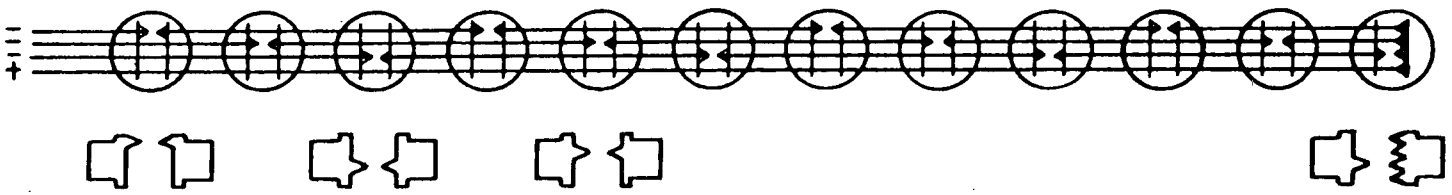
Figure 11:
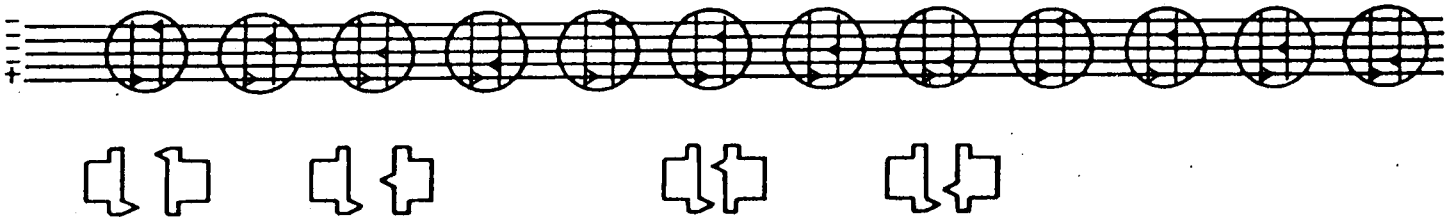
Figure 12:
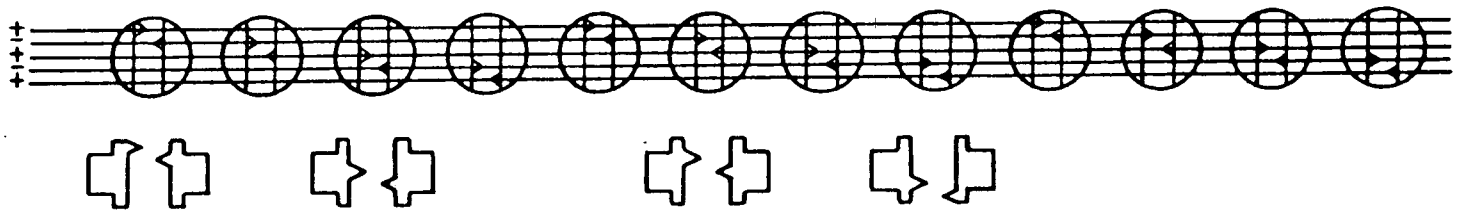
Figure 13:
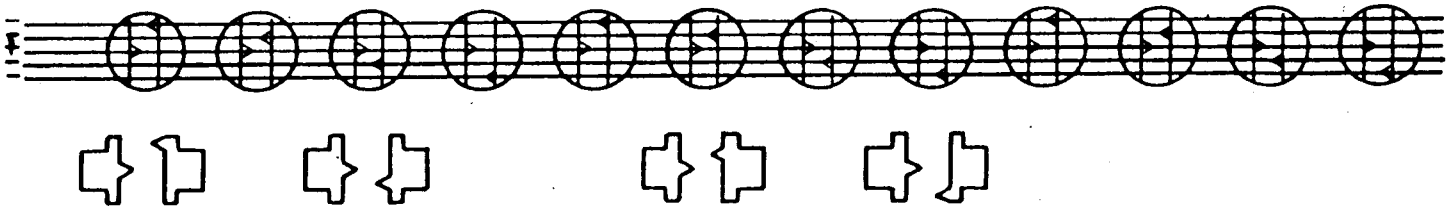
Figure 14:
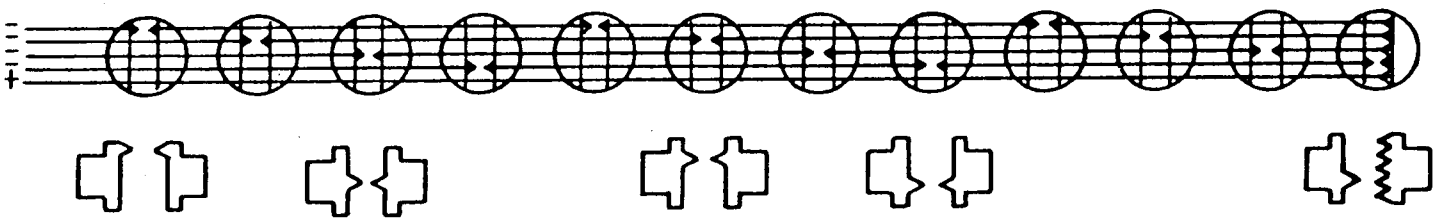
Figure 15:
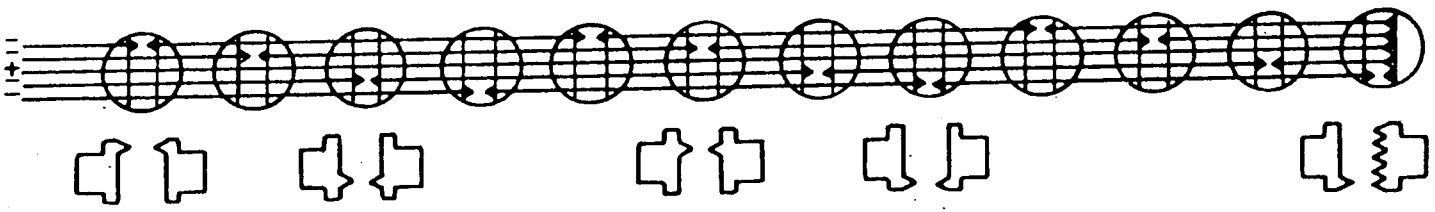
Figure 16:
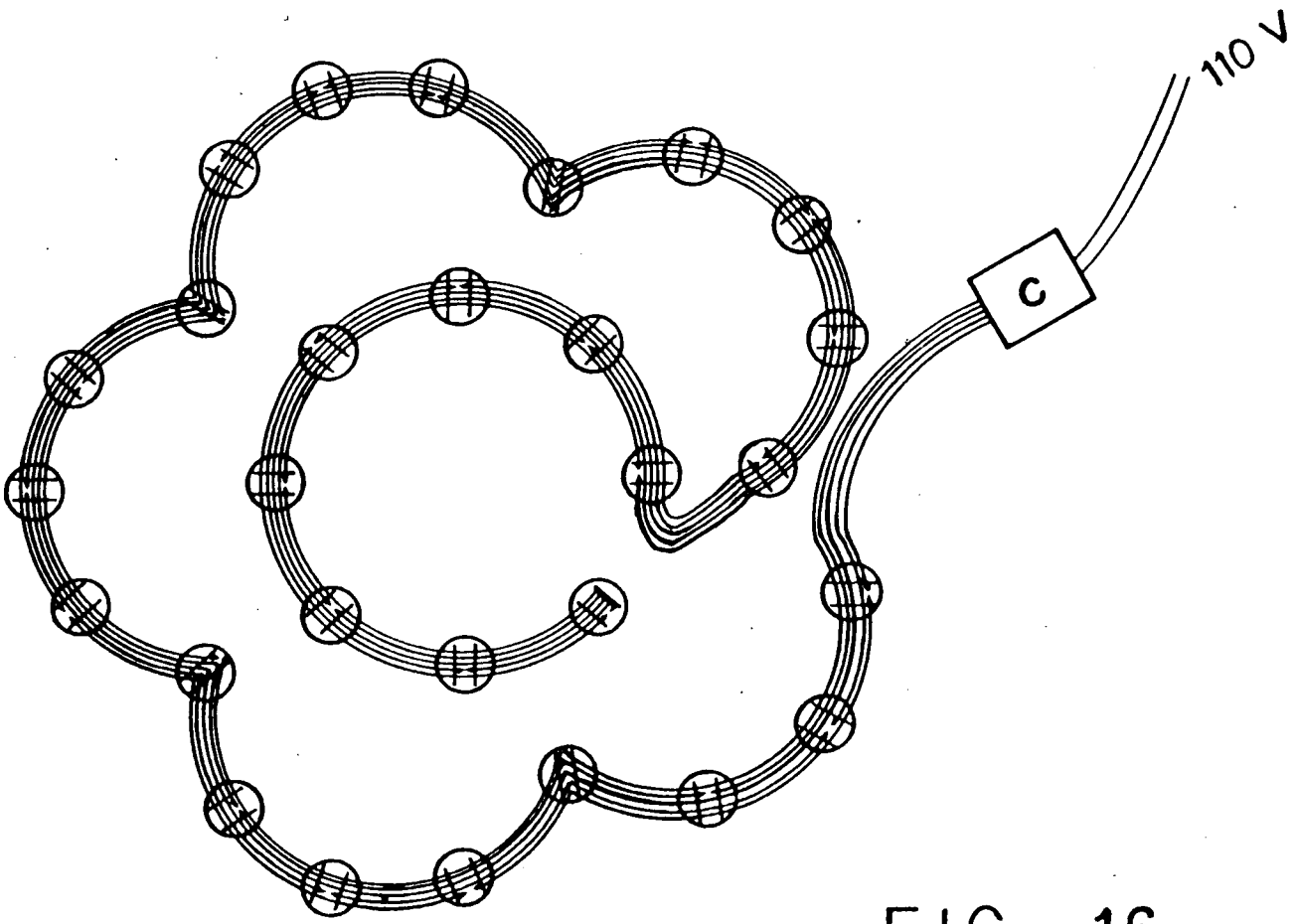

As shown in FIGS. 4–6, such shows that the present invention can be connected in series or parallel to obtain different embodiments. FIGS. 7–16 show several different connection combination made by the peaks 31 of the conductors 3 and the wires 4. It will be realized that the peaks of conductors 3 can be suitably selected to provide different states of sparkling of the bulbs 5, which does not require any controller, and yet has similar effect. This increases utility and advantages of the system.

Although this invention has been described in connection with specific forms and embodiments thereof, it is to be understood that all matter herein described or shown in the accompanying drawings is to be interpreted as illustrative and not in a limiting sense. Thus it will be appreciated that the drawings are exemplary of a preferred embodiment of the invention. Various modifications may be made without departing from the scope of the appended Claims.

What is claimed is:

1. An improved miniature light set, comprising:

base member defined by housing having a substantially cylindrical shaped outer wall and having an open first end for receiving a light bulb in an interior space defined by said outer wall, said base member first end having a substantially circular cross-sectional contour truncated by a pair of flat surface portions substantially symmetrically formed on opposing sides thereof, whereby said base member can be transported and assembled automatic equipment, said base member having an opposing closed second end having a recess formed therein, said second end further having a pair of slotted through opening formed within said recess and in open communication with said interior space for receiving a respective pair of electrical conductors, said second end having an opposing pair of apertures formed within said recess and disposed in a direction substantially perpendicular to said slotted through openings;

a seat defined by a substantially circular disk shaped member having an pair of flat surface portions substantially symmetrically disposed on opposing edges of said disk shaped member, whereby said seat can be transported and assembled by automatic equipment, said seat including (1) a pair of hooks depending from a bottom surface of said disk shaped member for respective engagement within said pair of apertures of said base member, and (2) a plurality of arcuate grooves formed on said bottom surface of said disk shaped member for engaging a plurality of wires within said recess of said base member; and, each of said pair of electrical conductors being formed with a wire piercing peak disposed in a predetermined location for making electrical contact with a selected one of said plurality of wires.

2. The improved miniature light set as recited in claim 1 wherein said plurality of wires is defined by four wires.

3. The improved miniature light set as recited in claim 1 wherein said plurality of wires is defined by five wires.

* * * * *